US006793607B2

(12) United States Patent
Neil

(10) Patent No.: US 6,793,607 B2
(45) Date of Patent: Sep. 21, 2004

(54) WORKOUT ASSISTANT

(75) Inventor: Dallas B. Neil, Lawrencevillee, GA (US)

(73) Assignee: Kinetic Sports Interactive, Missoula, MT (US)

( * ) Notice: Subject to any disclaimer, the term of this patent is extended or adjusted under 35 U.S.C. 154(b) by 0 days.

(21) Appl. No.: 10/350,315

(22) Filed: Jan. 22, 2003

(65) Prior Publication Data

US 2003/0171188 A1 Sep. 11, 2003

Related U.S. Application Data

(60) Provisional application No. 60/349,402, filed on Jan. 22, 2002.

(51) Int. Cl.[7] ..... A63B 21/00

(52) U.S. Cl. ..... 482/8; 482/9; 482/900

(58) Field of Search ..... 482/1–9, 900–902, 482/91

(56) References Cited

U.S. PATENT DOCUMENTS 6,358,187 B1 * 3/2002 Smith ..... 482/4
6,582,342 B2 * 6/2003 Kaufman ..... 482/8
6,595,901 B2 * 7/2003 Reinbold et al. ..... 482/91

* cited by examiner

*Primary Examiner*—Glenn E. Richman
(74) *Attorney, Agent, or Firm*—Kolisch Hartwell, P.C.

(57) ABSTRACT

An exercise monitoring system. The monitoring system is configured to acquire workout information from an exercise equipment device that includes a set of selectable resistive elements, such as a weight stack. The monitoring system includes a testing subsystem, sensing subsystem, and processor that cooperate to acquire the workout information by monitoring the set of selectable resistive elements.

20 Claims, 2 Drawing Sheets

WORKOUT ASSISTANT

CROSS-REFERENCE TO RELATED APPLICATIONS

This application is based on and claims priority under 35 U.S.C. §119(e) from the following co-pending provisional patent application, which is incorporated herein by this reference, in its entirety and for all purposes: DIGITAL WORKOUT ASSISTANT, Ser. No. 60/349,402, filed Jan. 22, 2002.

BACKGROUND OF THE INVENTION

Working out in a safe and efficient manner poses a difficult problem in the field of exercise science. Individuals often lack knowledge regarding effective goal-specific workout regimens designed to produce optimal training benefits in the safest, most efficient manner possible. Furthermore, individuals often do not understand proper exercise form and therefore perform exercises with improper technique, which increases the risk of injury and lessens the benefits of exercise. Thorough workout records are often not compiled, making it difficult to perform meaningful analysis on past performance and adjust a workout regime to maximize benefit.

One solution to the above problems is to utilize a personal trainer. However, personal trainers often are expensive, and scheduling training appointments may be inconvenient. Furthermore, even the best personal trainers are limited in their ability to record and analyze data produced from each workout in an efficient real-time manner. Therefore, personal trainers are not an ideal solution for many individuals.

SUMMARY OF THE INVENTION

An exercise monitoring system is provided. The monitoring system is configured to acquire workout information from an exercise equipment device that includes a set of selectable resistive elements, such as a weight stack. The monitoring system includes a testing subsystem, sensing subsystem, and processor that cooperate to acquire the workout information by monitoring the set of selectable resistive elements.

DETAILED DESCRIPTION OF THE INVENTION

Figure 1:
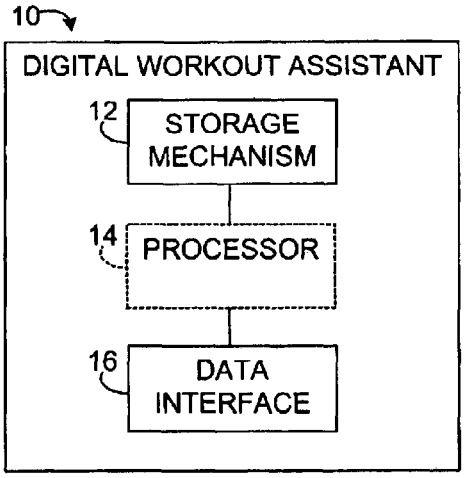
FIG. 1 is a block diagram of a digital workout assistant configured to assist in effective exercise.

FIG. 1 schematically illustrates a digital workout assistant 10, which includes a storage mechanism 12 configured to store data. The stored data may be used by the digital workout assistant or an external device to improve exercise effectiveness and/or convenience. For example, the data may include a fitness training program detailing recommended exercises designed to help the individual reach a fitness goal. The data may include exercise equipment settings, which correspond to a particular individual. Historical information regarding an individual's fitness training performance may be stored so that progress may be tracked over time. Nutritional plans along with nutritional information about particular foods may be stored so that an individual may follow a diet. Different types of information may additionally or alternatively be stored, depending on the particular desired application of the digital workout assistant.

Storage mechanism 12 may include one or more structures for storing data. For example, a magnetic strip, a magnetic disk, a semiconductor memory, an optical storage medium, or similar structure may be used. Data may be stored on storage mechanism 12 as digitally encoded data, which may be compressed, uncompressed, encrypted, and/or unencrypted. In some embodiments, the storage mechanism includes at least one nonvolatile memory portion, so that data may be stored without a constant supply of power. The data stored typically is rewritable, meaning that the contents of the storage mechanism may be repeatedly altered, so that old data may be overwritten with new data when desired.

In some embodiments, the digital workout assistant may include an optional processor 14. The storage mechanism may store instructions that may be selectively executed by the processor in accordance with programmed logic. To this effect, one or more programs may be run by the workout assistant. Such programs may be designed to further facilitate improved exercise. For example, programs designed to input and/or analyze workout information may be executed by processor 14. In this manner, the exercises performed, repetitions, resistance levels, durations, etc. of a workout may be received by the workout assistant. The information may be manually input via an input device, which may be a constituent component of the digital workout device, or by an external peripheral, depending on the embodiment. In some embodiments, the digital workout assistant is configured to receive such information directly from another device, such as a monitoring system configured to automatically acquire such information from exercise equipment, as discussed below. It should be understood that other programs, such as databases configured to track food intake, may also be executed by processor 14.

Programs executed by processor 14 may utilize data stored on storage mechanism 12. For example, programs designed to recommend exercises, based on past exercise performance, fitness goals, diet, and/or other information stored on data storage mechanism 12 may be executed by processor 14. In some embodiments, processor 14 is configured to access external information, such as information stored on a personal computer, a monitoring system of an exercise equipment device, another digital workout assistant, etc.

As illustrated, digital workout assistant 10 includes a data interface 16, which is configured to facilitate sending and receiving data to and/or from storage mechanism 12. Such exchange of data facilitates either unidirectional or bidirectional communication between digital workout assistant 10 and external devices, such as personal computers, monitoring systems, and/or other workout assistants. Data previously stored on the digital workout assistant may be uploaded to an external device and/or data may be downloaded from an external device. As discussed below with reference to exemplary embodiments of digital workout assistant 10, data interface 14 may take the form of a mechanical connection, electrical connection, and/or a wireless transmission mechanism.

Digital workout assistant 10 may be configured to work in conjunction with exercise equipment. In some embodiments, the digital workout assistant is configured to store equipment-specific settings that may be accessed by the exercise equipment. The types of equipment-specific settings that may be stored include, but are not limited to, resistance settings, workout duration settings, equipment configuration settings, and settings corresponding to a particular individual's physical dimensions and/or exercise preferences. When exercise equipment of the present invention receives the settings from the digital workout assistant, the equipment may automatically make adjustments in response to the received settings, thus preparing for use in response to those settings. For instance, a leg press machine may automatically set the resistance to a level specified by the digital workout assistant and reconfigure itself to ergonomically accommodate an individual according to stored settings. As another example, an elliptical trainer may prepare an exercise session with a desired duration, intensity, and virtual course. It should be understood that different settings may be required for different exercise equipment, and that some settings may apply to multiple exercise equipment devices. Furthermore, some embodiments may be configured to utilize only a subset of the features described herein.

Digital workout assistant 10 may be adapted to receive workout information from the exercise equipment. As an individual exercises, the digital workout assistant may receive and store exercise-specific information such as resistance level, number of repetitions, range of motion, exercise rate, exercise duration, heart rate, estimated calories of energy used, and other relevant information. This information may then be used to report progress and/or to automatically adjust workouts to achieve maximum benefit. The information may be made available to the individual in real-time during exercise via a display mechanism and/or an audio mechanism. The display and/or audio mechanism may be a component of the digital workout assistant, the exercise equipment, a monitoring system, or an external device adapted to interface with at least one of the exercise equipment and the digital workout assistant. The information may also be saved in digital format. Such information may later be analyzed, such as by a personal computer. Furthermore, saved information provides a convenient mode of saving workout information over time, so that an individual can track progress, attempt to correlate exercise improvements to other journaled life activities, etc.

The digital workout assistant may interface with other components, such as a monitoring system, through one or more of a variety of mechanisms. For instance, the digital workout assistant may include a magnetic output strip configured to present information stored on the assistant. Alternatively or in addition to the magnetic strip, the digital workout assistant may interface with other components via optical transmission, wireless transmission, and/or electrical transmission. The data exchange may occur via a proprietary interface or a standards based interface such as universal serial bus (USB), USB 2.0, BlueTooth, IEEE 1394, IEEE 802.11b or other standards based interfaces.

The digital workout assistant may incorporate additional functionality. For example, the digital workout assistant may include a clock, a music playback mechanism, a heart-rate monitor, a pedometer, a personal digital assistant, or other useful functionality. The digital workout assistant may take the form of a card similar to a credit card, a device worn like a wristwatch, a device worn on a lanyard, a handheld device, an article of clothing, or any other suitable form.

It is understood that virtually any information that may assist the individual may be stored in the digital workout assistant, and the digital workout assistant may be configured to work in conjunction with devices in addition to exercise equipment. For instance, the digital workout assistant may include lock information adapted to open a locker and/or permit access to restricted areas in a gym and/or other facility. If the individual prefers a particular music style, the digital workout assistant may be adapted to automatically adjust a music playback device to output music of the preferred variety. The digital workout assistant may be used to scan codes on food items so that the nutritional information of the food item may be recorded and analyzed in relation to the individual's diet. Such nutritional information may be analyzed in relationship to the individual's workout information and used to provide workout and nutrition advice tailored to help the individual reach specified fitness goals. It should be understood that other information may be analyzed, and other advice may be provided.

Figure 2:
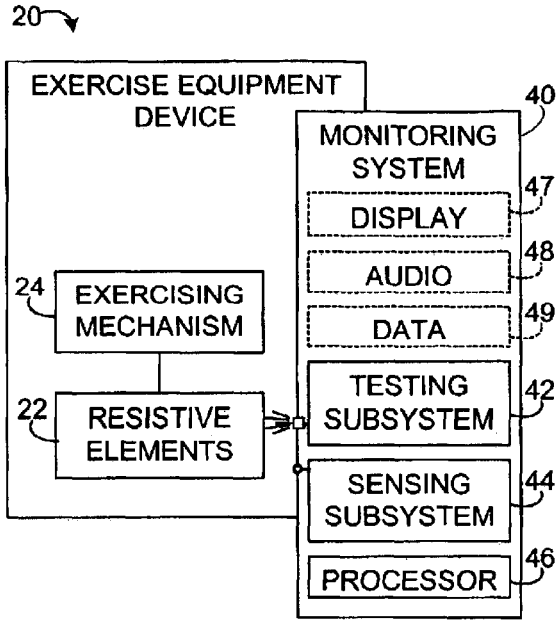
FIG. 2 is a block diagram of an exercise equipment device and a monitoring system configured to acquire workout information from the exercise equipment device.

FIG. 2 schematically shows an exemplary exercise equipment device 20, which includes a set of selectable resistive elements 22. The net effective resistance level of the exercise equipment device may be set by selecting a subset of these resistive elements. Such sets of resistive elements are commonly used to provide resistance training that may be easily varied to suit an individual's needs. Exercise equipment device 20 also includes an exercising mechanism 24 that is operatively coupled to the set of resistive elements. Exercising mechanism 24 generally includes various cables, pulleys, levers, grips, and/or other componentry configured to position an individual to exercise a targeted group of muscles through a desired range of motion. Various exercising mechanisms may be designed to exercise different body parts in different ways, as is well known in the art of exercise science.

Figure 3:
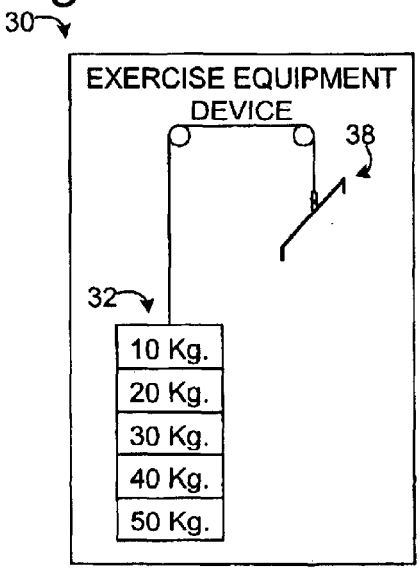
FIGS. 3 and 4 are somewhat schematic illustrations of an exercise equipment device including a weight stack.

FIG. 3 schematically shows exercise equipment device 30, which includes a set of resistive elements in the form of 5 weights arranged as a weight stack 32. In other embodiments, resistive elements may take the form of elastic bands, resilient bars, springs, magnets, etc. When the resistive elements take the form of a weight stack, a subset of weights may be selected, where the subset may consist of the top weight, the two topmost weights, the three topmost weights, etc. As each additional weight is selected, the net resistance of the exercise equipment device increases a corresponding amount. For example, and with reference to FIG. 3 where each weight is 10 Kilograms, if the top weight is selected the net resistance of the exercise equipment device is said to be 10 Kilograms, if the top two weights are selected the net resistance is said to be 20 Kilograms, and so on. When an exercise is performed, the selected weights are activated, or lifted, and move in relationship to the unselected weights.

Figure 4:
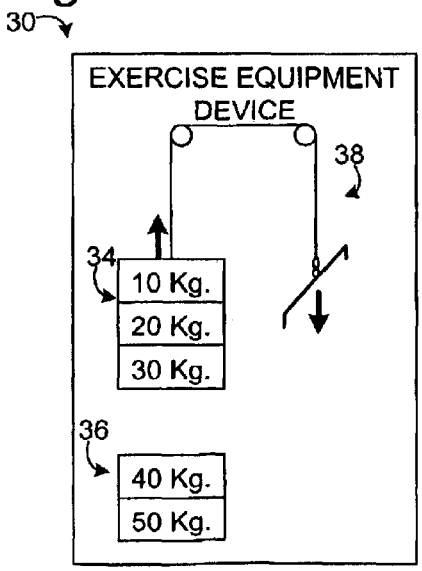

FIG. 4 schematically shows an example where the top three weights have been selected, forming a selected subset 34. During an exercise repetition, the selected resistive elements are said to be activated, meaning that they are applying their individual resistances to the net resistance of the device. In contrast, the unselected resistive elements, 36, are not contributing to the net resistance. As shown, the net resistance is 30 Kilograms because 3 weights of 10 Kilograms make up the selected subset. Selected weights are typically pulled away from the unselected weights by an exercising mechanism 38. In the illustrated embodiment, exercising mechanism 38 is a pull-down mechanism, which is often used to exercise back muscles or triceps.

FIG. 2 shows a monitoring system 40 that is configured to acquire workout information from exercise equipment device 20. The monitoring system includes a testing subsystem 42, a sensing subsystem 44, a processor 46, and in some embodiments, a display subsystem 47, an audio subsystem 48, and/or a data subsystem 49. Testing subsystem 42 is configured to apply one or more signals to an exercise equipment device. The signals are generally collectively referred to as a query. Sensing subsystem 44 is configured to detect the query, which changes state in response to how the exercise equipment is being used. Processor 46 is coupled to the testing and sensing subsystems, and is typically responsible for controlling the application of the query, and for processing information gathered by the sensing subsystem. In this manner, the exercise equipment may be monitored to determine how it is being used. For example, information regarding resistance levels, number of repetitions, range of motion, exercise duration, exercise speed, etc. may be acquired.

Display subsystem 47 may include a video display and an input mechanism such as a series of buttons, a membrane switch, a mechanical switch, touch screen, and/or other suitable input device. The video display may be configured to play instructional digital videos of specific exercises, play videos demonstrating safety techniques for health and fitness training, play videos that guide users through a specific workout, etc. As such, graphical representations of human forms may be displayed with the option to select different muscle groups. When a muscle group is selected, the display may play videos showing how the selected muscle groups may be exercised, or provide other information relating to those muscle groups.

The display subsystem may also be used to display a graphical user interface controlled by the input mechanism, which an individual may use to view acquired workout information, information regarding past performance, or similar information. Furthermore, when included, the graphical user interface may be used to effectuate a transfer of data from the monitoring system to another device, such as a digital workout assistant, although such transfer is preferably automatically activated. Such transfers are directed to the data subsystem 49, which may be configured with a data I/O interface configured to implement any of the transfer mechanisms described herein, as well as other appropriate transfer mechanisms. In some embodiments, the display functionality may be separated from the testing and sensing subsystems, and used as a separate device with independent utility.

In some embodiments, monitoring system 40 is an integrated component of the exercise equipment device. In other embodiments, the monitoring system is configured as a peripheral add-on, which may be retrofit to exercise equipment that was not originally designed with a monitoring system. Depending on the type and configuration of exercise equipment, monitoring systems may be variously designed to cooperate with the exercise equipment to acquire workout information when the exercise equipment is used. Furthermore, a particular type of exercise equipment device may be serviced by more than one type of monitoring system. To illustrate this point, several exemplary embodiments configured to cooperate with a weight stack, which may be a component of many different types of exercise equipment devices, are provided below. It should be understood that these are provided as nonlimiting examples, and other monitoring systems may be used.

Figure 5:
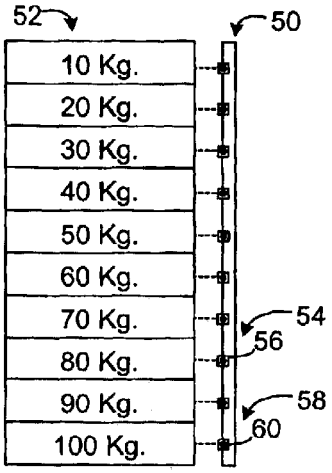
FIGS. 5–9 are somewhat schematic illustrations of different embodiments of the monitoring system of FIG. 2 used in conjunction with a weight stack.

FIG. 5 shows monitoring system 50 in position to monitor weight stack 52, which is a component of an exercise equipment device (not shown). Monitoring system 50 may be positioned by means of a mounting mechanism compatible with the particular exercise equipment device being monitored. In the illustrated embodiment, the monitoring system includes a testing subsystem 54, which in turn includes a plurality of emitters, such as emitter 56. Emitter 56, as well as other emitters of testing subsystem 54, are shown as squares for the purpose of illustration. Each weight of stack 52 corresponds to an emitter, typically in a one-to-one correspondence. Each emitter is configured to emit a detectable signal, such as a beam of visible light, although other signals, such as radio signals and infrared signals may be used. Depending on the type of signal, emitters may take various forms. Laser emitters operating off of circuit boards have been found to perform adequately in most circumstances. In the illustrated embodiment, such signals are schematically represented as dashed lines. As explained below, the signals collectively make up a detectable query, which may be used to monitor the weight stack.

Monitoring system 50 also includes a sensing subsystem 58 that includes one or more receiver, such as receiver 60, configured to detect signals from the emitters of the testing subsystem. Receiver 60, as well as other receivers of the sensing subsystem, are schematically shown as circles for the purpose of illustration. Each weight of stack 52 corresponds to a receiver, typically in a one-to-one correspondence. Furthermore, each receiver corresponds to an emitter. In the illustrated embodiment, the receivers are physically located proximate their corresponding emitters. The emitters are configured to send a signal to their corresponding weight, and when the weight is at rest, the receiver is configured to detect the signal as it reflects off of the weight itself, or off of a reflector attached to the weight. If the weight is not at rest (activated), it will not be present to reflect the signal. In this manner, the sensing subsystem is configured to monitor the weight stack by monitoring the individual signals from the emitters, which collectively make up the detectable query. Information from the receivers may be processed and analyzed by the monitoring system's processor.

Figure 6:
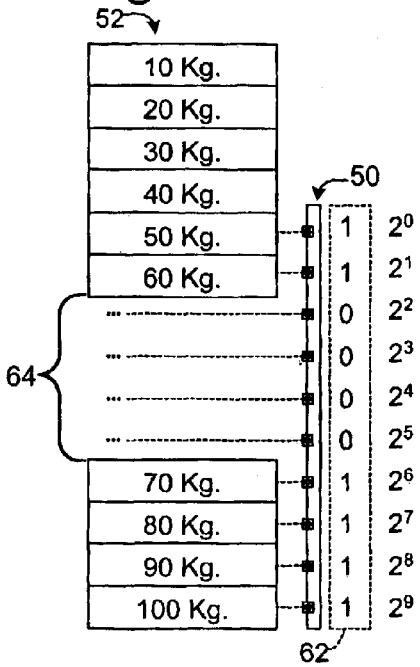

As used herein, the state of the detectable query refers to the combination of emitted signals that are detected and undetected by the receiver(s) of the sensing subsystem. For the purpose of explanation, detectable query states are herein described as binary numbers with each digit of the binary number representing whether a signal corresponding to a particular weight is detected. The least significant digit of the binary number corresponds to the top most weight, while the most significant digit corresponds to the bottom most weight. A "1" represents a detected signal and a "0" represents an undetected signal. For example, FIG. 6 shows a weight stack at the apex of a repetition. In this position, the stack yields a detectable query state of 1111000011, as is schematically indicated at 62. FIG. 6 also shows, next to each digit of the binary number that represents the state of the query, the significance of that digit. For the sake of comparison, FIG. 5 shows a weight stack position that yields a detectable query state of 1111111111, because none of the weights are activated. This is a useful convention for understanding one possible way of using a detectable query to monitor exercise equipment, but it should be understood that other conventions may be equally as applicable, and the convention set forth is provided as a nonlimiting example. In particular, other queries may be more appropriate for monitoring exercise equipment devices without a set of selectable resistive elements.

Using the convention set forth above, the most significant digit of the binary number that is a "0" indicates the net resistance to which the exercise equipment device is set, because the most significant digit (first digit when reading from left to right) that has changed to zero corresponds to the bottom most weight that is lifted. Of course, all weights above the bottom most lifted weight are also being lifted, and thus contributing their weight to the net resistance. For example, FIG. 6 shows that the sensing subsystem has detected a query state of 1111000011, in which the most significant digit to change from a "1" to a "0" is the digit in the $2^5$ place. This indicates a subset of weights including the top 6 weights are providing a net resistance of 60 Kilograms (6×10 Kilograms), because the digit in the $2^5$ place corresponds to the sixth weight from the top of the stack.

This convention can be used to determine the net resistance indicated by any state of the detectable query, as represented by a binary number. For example, and using the system of FIG. 6, which includes 10 weights of 10 Kilograms each, binary numbers having their first "0" in the first digit (0xxxxxxxxx) indicate a net resistance of 100 kilograms. All binary numbers having their first "0" in the second digit (10xxxxxxxx) indicate a net resistance of 90 kilograms. All binary numbers having their first "0" in the third digit (110xxxxxxx) indicate a net resistance of 80 kilograms, and so on. The digits in less significant places than the first "0" are not needed to determine the net resistance. However, they may be used to determine range of motion.

The least significant and most significant digits that are a "0" collectively indicate the range of motion for a given repetition, because the least significant digit that is a "0" indicates how high the bottom most selected weight has been lifted. In the illustrated example, the least significant digit to change from a "1" to a "0" is the digit in the $2^2$ place. Therefore, the weights have been displaced by the approximate equivalent of 4 times the height of each weight. Another way to say this is that the number of "0" digits in the middle of the binary number represents a multiplier by which the height of the weight may be multiplied. Assuming 10 centimeter tall weights, this yields a range of motion 64 of 40 centimeters (4×10 centimeters) ±5 centimeters. Depending on the exercising mechanism used by a particular machine, this range of motion may be adjusted to correspond to an actual exercising range of motion as opposed to the distance the weights travel.

The following table provides the net resistance and range of motion as indicated by a nonexhaustive list of binary numbers according to the above described system. Of course, different exercise equipment devices may use weights of different increments, different heights, or otherwise differ from the example used above. Therefore, the binary numbers used as examples may indicate different information in other embodiments. Likewise, other monitoring systems may not use a binary number to represent the state of the detectable query, but rather another suitable method. Therefore, the below table should be viewed as a nonlimiting example, provided for the purpose of illustration.

TABLE 1

Net Resistance and Range of Motion Indicated by State of Detectable Query

| STATE OF QUERY | NET RESISTANCE (kg) | RANGE OF MOTION (+/−5 cm) |
|---|---|---|
| 0000000000 | 100 | ≧100 |
| 1000000000 | 90 | ≧90 |
| 1100000000 | 80 | ≧80 |

TABLE 1-continued

Net Resistance and Range of Motion Indicated by State of Detectable Query

| STATE OF QUERY | NET RESISTANCE (kg) | RANGE OF MOTION (+/−5 cm) |
|---|---|---|
| 1110000000 | 70 | ≧70 |
| 1111000000 | 60 | ≧60 |
| 1111100000 | 50 | ≧50 |
| 1111110000 | 40 | ≧40 |
| 1111111000 | 30 | ≧30 |
| 1111111100 | 20 | ≧20 |
| 1111111110 | 10 | ≧10 |
| 1111111111 | 0 | — |
| 1000000000 | 90 | 90 |
| 1000000001 | 90 | 80 |
| 1000000011 | 90 | 70 |
| 1100000000 | 80 | 80 |
| 1100000001 | 80 | 70 |
| 1100000011 | 80 | 60 |
| 1110000000 | 70 | 70 |
| 1110000001 | 70 | 60 |
| 1110000011 | 70 | 50 |

The net resistance and the range of motion may be used to calculate a total work performed for each repetition using the following equation:

$$\text{Total Work}=(\text{Net Resistance})(\text{Range of Motion})$$

The total work performed for all repetitions may be calculated by summing the total work performed for each repetition. Other calculations may be made to further analyze a workout. For example, the total work performed may be converted into calories used.

Figure 7:
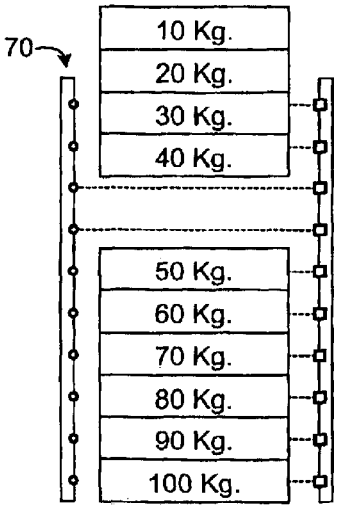
Figure 8:
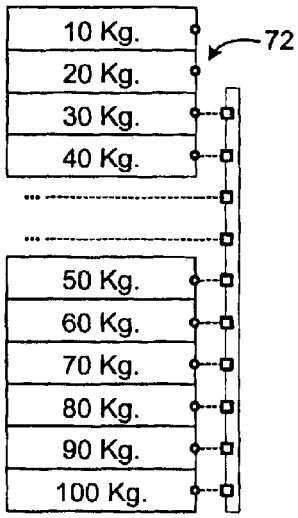

Sensing subsystems may be configured differently than that shown in FIG. 6. For example, as shown in FIG. 7, a sensing subsystem 70 may be positioned opposite the testing subsystem, with the weight stack intermediate the testing and sensing subsystems. In such an arrangement, a weight corresponding to an emitter and a receiver blocks the signal from the emitter when the weight is at rest. Therefore, a receiver detects the signal when the weight is activated. This is essentially the opposite situation as that described with reference to FIG. 6. In some embodiments, as shown in FIG. 8, a sensing subsystem 72 may be distributed about the weight stack. In such arrangements, the receiver corresponding to each weight is physically connected to that weight and positioned to detect light from a corresponding emitter when the weight is at rest. In such an arrangement, it may be advantageous to configure each emitter to emit an identifiable signal.

A monitoring subsystem may be configured to monitor an exercise equipment device over time. Repetitions may be counted by tracking when all weights of a stack return to rest, such as by detecting a query state of 1111111111 in the above described example. A minimum range of motion may be set for a lift to count as a repletion. As schematically shown in FIG. 2, the monitoring system may include a visual display for presenting information such as resistance level and number of repetitions to a user. Similarly, the monitoring system may include a speaker or other sound transducer for audibly counting off the repetition number as a user exercises. In between each resting position, a maximum range of motion may be detected. Furthermore, a time to complete each exercise or a set of exercises may be recorded. Other information may also be accumulated, such as pulse rate, which may be acquired by the monitoring system or input from an external device via the data subsystem. Along with the net resistance level, this and other information may be stored and/or transmitted to another device.

Figure 9:
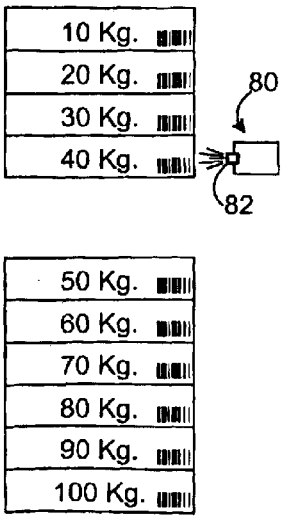

FIG. 9 shows another monitoring system 80 that is configured to acquire workout information. Monitoring system 80 includes an optical detecting device 82, such as a visible laser diode, which is configured to scan coded indicia located on the individual weights of a weight stack, or in other words, apply a detectable query to the weight stack. As shown, the coded indicia take the form of bar codes, although other coded indicia may alternatively be used. Optical detecting device 82 may be positioned and configured to scan weights that pass through a field of view, and thus track what weights pass through that field. In some embodiments, monitoring system 80 may utilize more than one optical detecting device to monitor different fields. In some embodiments, monitoring system 80 may scan any weights that move, because the monitoring system's field of view includes the entire weight stack. Similar to the embodiments described above, monitoring system 80 may be used to determine the resistance level, range of motion, and number of repetitions performed.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the disclosure recites "a" or "a first" element or the equivalent thereof, such disclosure should be understood to include incorporation of one or more such elements, neither requiring nor excluding two or more such elements.

Inventions embodied in various combinations and subcombinations of features, functions, elements, and/or properties may be claimed in a related application. Such new claims, whether they are directed to a different invention or directed to the same invention, whether different, broader, narrower or equal in scope to any original claims, are also regarded as included within the subject matter of the inventions of the present disclosure.

What is claimed is:

1. A monitoring system configured to acquire workout information from an exercise equipment device that includes a set of selectable resistive, elements, wherein a net resistance of the exercise equipment device is determined by a selected subset of the resistive elements; the monitoring system comprising:

a testing subsystem configured to apply a detectable query to the resistive elements, wherein the detectable query changes state when an exercise repetition is performed, and wherein the change of state indicates the resistive elements that are selected;

a sensing subsystem configured to monitor the state of the detectable query; and a processor configured to determine the net resistance and to count the number of repetitions performed according to the monitored state of the detectable query.

2. The monitoring system of claim 1, wherein, for each resistive element, the testing subsystem includes a corresponding emitter and the sensing subsystem includes a corresponding receiver configured to conditionally receive a signal from the corresponding emitter.

3. The monitoring system of claim 2, wherein the corresponding receiver is configured to receive a signal from the corresponding emitter and reflected from the corresponding resistive element when the resistive element is inactive.

4. The monitoring system of claim 2, wherein the corresponding receiver is configured to receive a signal from the corresponding emitter and transmitted through a void left by the corresponding resistive element when the resistive element is active.

5. The monitoring system of claim 1, wherein the processor is further configured to determine a range of motion according to the monitored state of the detectable query.

6. The monitoring system of claim 5, wherein the processor is further configured to calculate a total work performed for each repetition by multiplying the net resistance and the range of motion.

7. The monitoring system of claim 1, wherein the monitoring system further comprises an interface configured to present the determined net resistance and counted repetitions.

8. The monitoring system of claim 7, wherein the interface includes a display configured to visually present the determined net resistance and counted repetitions.

9. The monitoring system of claim 7, wherein the interface includes a sound transducer configured to audibly present the counted repetitions.

10. The monitoring system of claim 7, wherein the interface includes an I/O interface configured to transfer the determined net resistance and counted repetitions as computer readable data.

11. An exercise equipment device, comprising:

a set of selectable resistive elements, wherein a net resistance of the exercise equipment device is determined by a selected subset of the resistive elements;

a testing subsystem configured to apply a detectable query to the resistive elements, wherein the detectable query changes state when an exercise repetition is performed, and wherein the change of state indicates the resistive elements that are selected;

a sensing subsystem configured to monitor the state of the detectable query;

a processor configured to determine the net resistance and to count the number of repetitions performed according to the monitored state of the detectable query; and an interface configured to present the determined net resistance and counted repetitions.

12. The exercise equipment device of claim 11, wherein each resistive element is a weight module of a weight stack.

13. The exercise equipment device of claim 12, wherein, for each weight module, the testing subsystem includes a corresponding emitter and the sensing subsystem includes a corresponding receiver.

14. The exercise equipment device of claim 13, wherein each weight module is configured to reflect a signal from the corresponding emitter to the corresponding receiver when the weight module is at rest.

15. The exercise equipment device of claim 13, wherein each weight module is configured to block a signal from the corresponding emitter to the corresponding receiver when the weight module is at rest.

16. The exercise equipment device of claim 11, wherein the interface includes a display configured to visually present the determined net resistance and counted repetitions.

17. The exercise equipment device of claim 11, wherein the interface includes a sound transducer configured to audibly present the counted repetitions.

18. The exercise equipment device of claim 11, wherein the interface includes an I/O interface configured to transfer the determined net resistance and counted repetitions as computer readable data.

19. The exercise equipment device of claim 11, wherein the processor is further configured to determine a range of motion according to the monitored state of the detectable query.

20. The exercise equipment device of claim 19, wherein the processor is further configured to calculate a total work performed for each repetition by multiplying the net resistance and the range of motion.

* * * * *